United States Patent [19]

Powell et al.

[11] 4,191,434

[45] Mar. 4, 1980

[54] REFRIGERATOR COMPARTMENT PARTITIONING MEANS

[75] Inventors: John M. Powell, Charlestown, Ind.; K. Bailey Keeling, Jr., Louisville, Ky.

[73] Assignee: General Electric Company, Louisville, Ky.

[21] Appl. No.: 928,934

[22] Filed: Jul. 28, 1978

[51] Int. Cl.[2] ..... F25D 11/00

[52] U.S. Cl. ..... 312/214; 312/347; 62/447; 49/488

[58] Field of Search ..... 312/214, 347, 296, 270; 62/447; 220/451; 49/488, 466

[56] References Cited

U.S. PATENT DOCUMENTS

| | | | |
|---|---|---|---|
| 712,240 | 10/1902 | Barnes et al. | 49/488 |
| 1,501,658 | 7/1924 | Gowran | 312/347 |
| 1,672,836 | 6/1928 | Whittier et al. | 312/214 |
| 2,450,305 | 9/1948 | Shoemaker | 62/447 |
| 2,884,296 | 4/1959 | Meilinger et al. | 312/347 |
| 3,160,448 | 12/1964 | Abernathy et al. | 312/347 |
| 3,338,651 | 8/1967 | Jacobson | 312/330 |
| 3,429,628 | 2/1969 | Laszlo | 312/214 |
| 3,815,669 | 6/1974 | Lindenschmidt | 62/447 |
| 3,865,448 | 2/1975 | Winterheimer | 312/214 |

*Primary Examiner*—Victor N. Sakran

*Attorney, Agent, or Firm*—Frederick P. Weidner; Radford M. Reams

[57] ABSTRACT

A refrigerator cabinet having a metal outer shell and a plastic inner liner, containing a partition between fresh food and freezer compartments formed of a metal plate defining the fresh food compartment ceiling, a rigid expanded styrene bead thermally insulating divider mounted on the plate, and a plastic tray forming the freezing compartment floor mounted on the divider. An elongated strip of flexible polyurethane is folded lengthwise over a vertical edge of the plate so as to form a compressible, resilient air tight thermal seal between the sides and back of the plate and the adjacent liner walls regardless of changes in the gap distance between the plate and liner caused by the thermal variations of refrigerator operation or reasonable manufacturing variations. The partition inserts into channels formed on the sides of the liner which are partially defined by upper ledges with overlap raised flat rims extending along the sides of the tray to prevent unsightly gaps from occurring between the tray and the liner as a result of thermal or manufacturing variations. Laterally projecting tabs formed on the sides of the rims at the front of the tray project behind frontal edges of the outer shell a distance sufficient to prevent unsightly gaps between the sides of the tray and the edges of the shell resulting from thermal variations or manufacturing variations.

6 Claims, 5 Drawing Figures

REFRIGERATOR COMPARTMENT PARTITIONING MEANS

BACKGROUND OF THE INVENTION

This invention relates generally to refrigerator cabinets and compartment partitioning means therefor, and more specifically to means for providing improved thermal separation between compartments in a refrigerator employing a plastic liner. The invention also relates to means for preventing unsightly gaps from developing between the partitioning means and liner occasioned by the thermal variations of refrigerator operation or reasonable manufacturing dimensional variations.

SUMMARY OF THE INVENTION

Briefly, in accordance with the subject invention, there is provided compartment partitioning means for a referigerator cabinet of the type containing a plastic inner liner which includes a metal plate defining a surface for a fresh food compartment having a raised edge extending along the side and back thereof. An elongated strip of compessible, resilient material is folded longitudinally over and along the edge to form an air insulating thermal seal between the edge and the adjacent walls of the liner. A mass of insulating material forming a thermal compartment divider is disposed against the plate, the strip also forming a thermally insulating seal between the plastic and the divider. A plastic tray defining a surface of a freezer comprtment and having raised flat rims extending along the sides thereof is disposed against the divider, the plate, divider and tray thereby forming a partition. A pair of channels is formed on the sides of the liner and extends from the front to the back thereof into which the partition is disposed. A pair of ledges defining one side of the channel overlaps the flat rims such that the liner and tray may be spaced relative to one another without producing an unsightly horizontal gap therebetween.

Additional objects, features and advantages of the present invention will become apparent to those skilled in the art from the following detailed description and attached drawings upon which by way of example, only the preferred embodiments of our invention is illustrated.

DESCRIPTION OF THE PREFERRED EMBODIMENT

Figure 1:
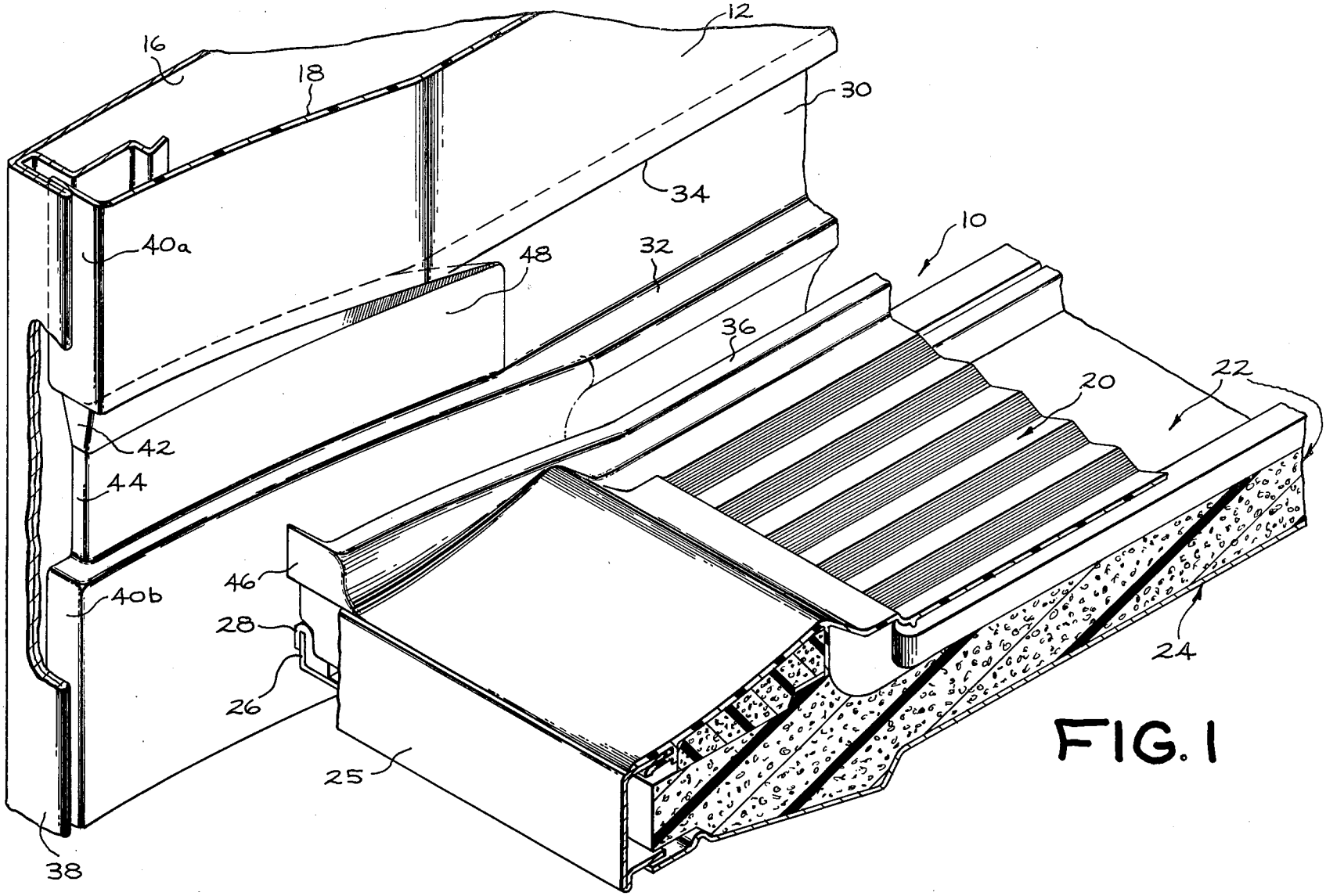
FIG. 1 shows an oblique and exploded view of portions of a refrigerator cabinet and compartment partition, thus illustrating one preferred embodiment of the subject invention.

Referring now to the drawings there is shown in one preferred embodiment of our invention, a partition 10 separating a freezer compartment 12 from a fresh food compartment 14 in a household or domestic refrigerator. The refrigerator cabinet in which the partition 10 is disposed includes an outer sheet metal shell 16 and an inner plastic liner 18 defining the sides, back and access opening of the refrigerator storage chamber.

Figure 2:
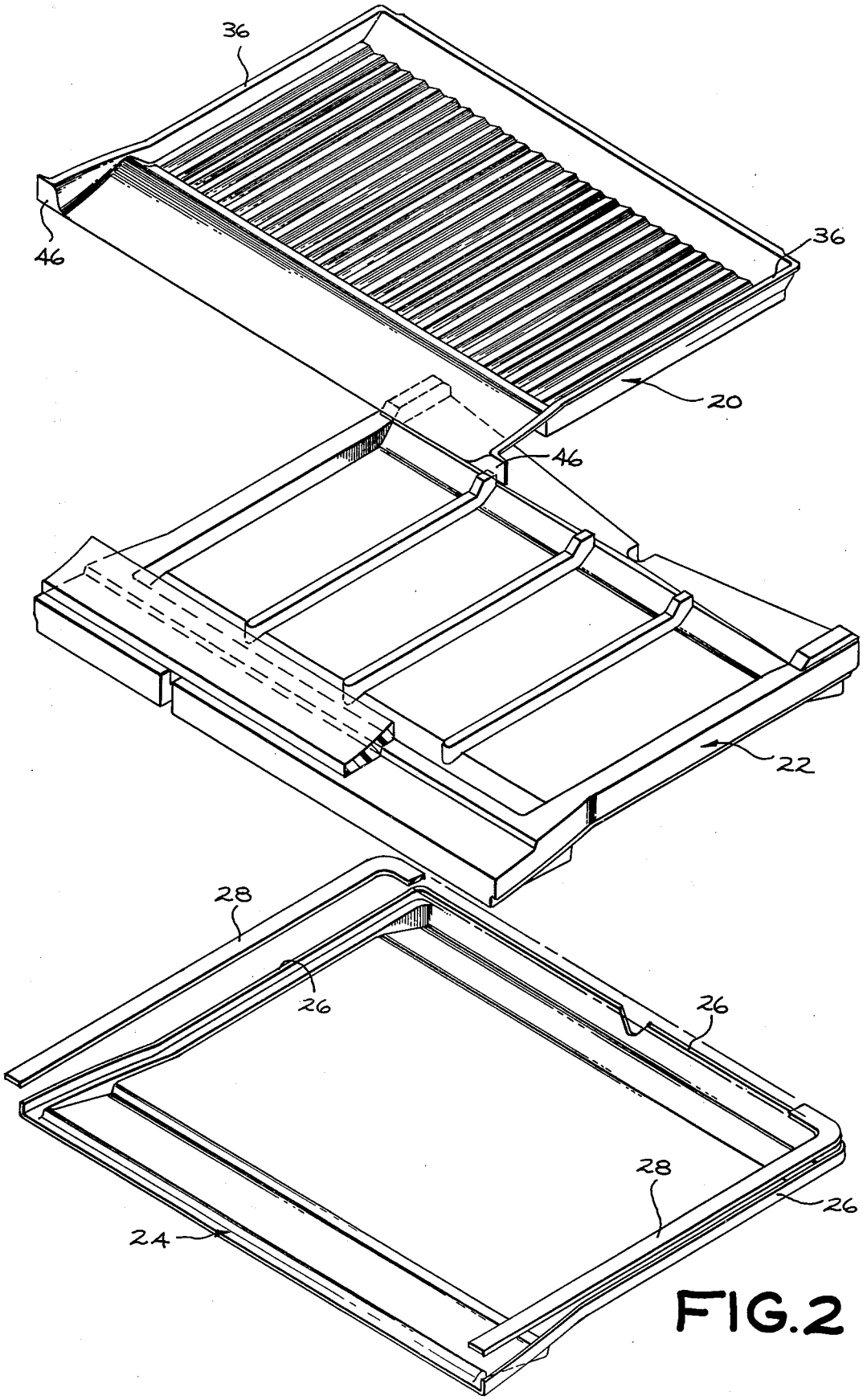
FIG. 2 shows an exploded oblique projection of the complete compartment partition, a portion of which is shown in FIG. 1.
Figure 3:
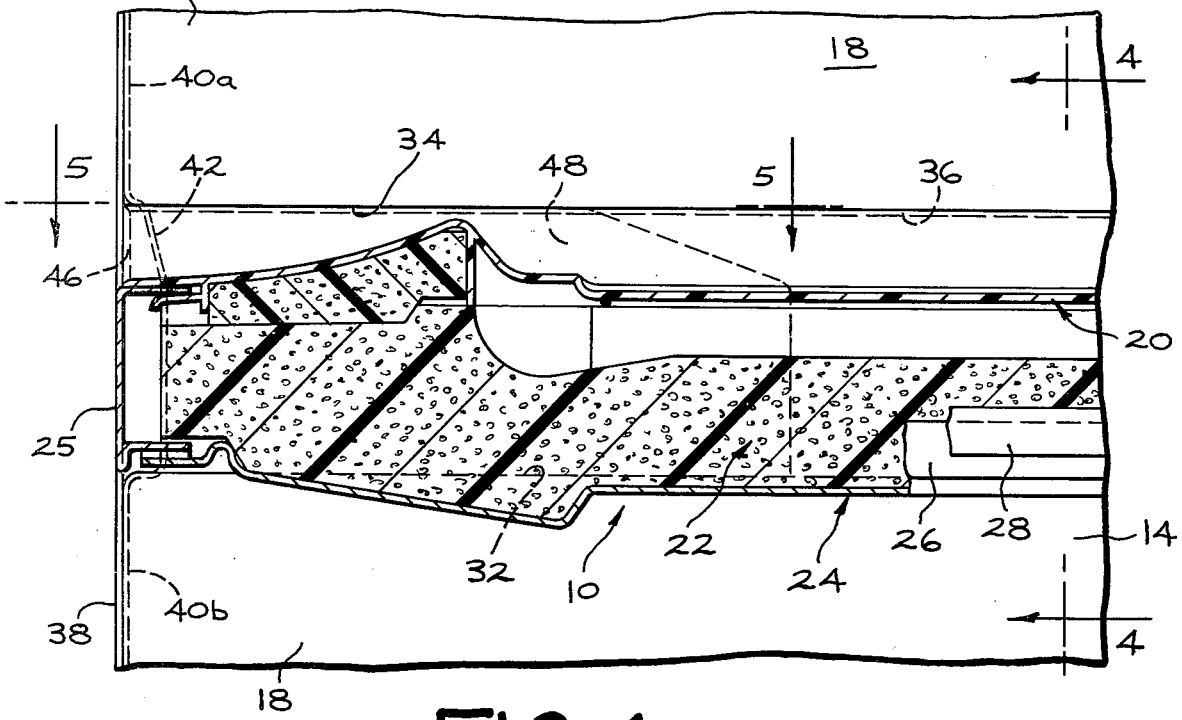
FIG. 3 shows a side elevation view of the cabinet and partition portions of FIG. 1.
Figure 4:
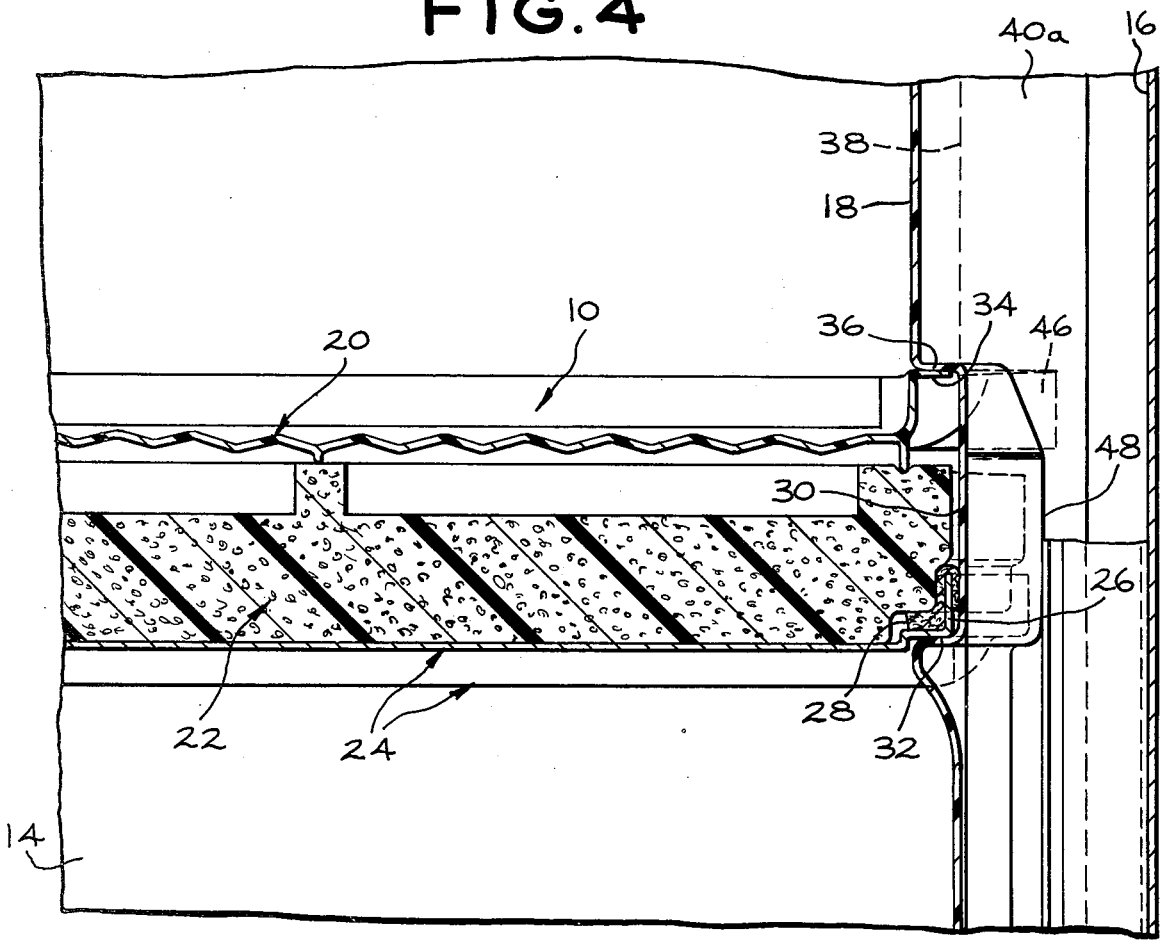
FIG. 4 shows a rear elevation view of the assembled portions of the cabinet and compartment partition of FIG. 1.
Figure 5:
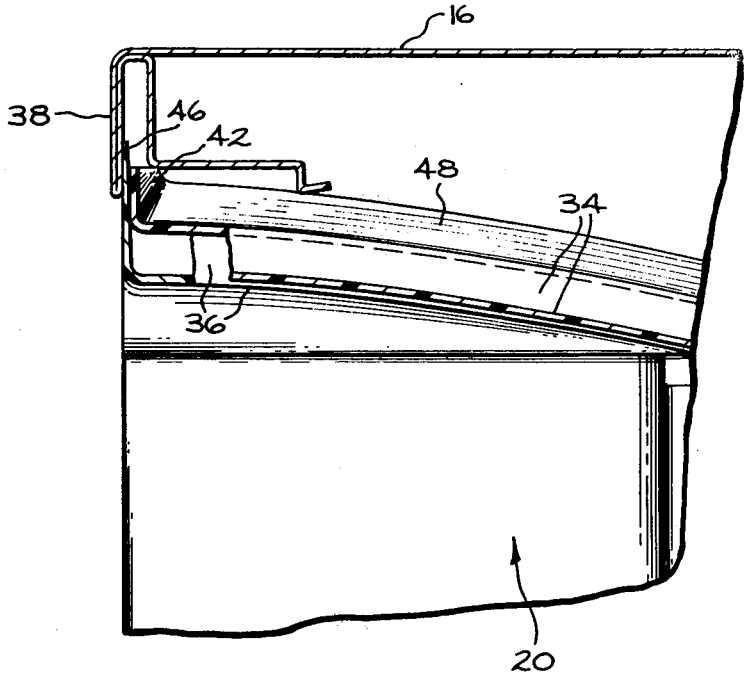
FIG. 5 shows a cross-sectional plan view of the cabinet and partition of FIG. 1 as viewed along lines 5—5 of that latter figure.

As best seen in FIG. 2, the partition 10 is a composite of three distinct elements, namely, a molded plastic tray 20 which forms the floor of the freezer compartment 12, a relatively rigid expanded styrene bead thermal insulator or divider 22, and a metal plate 24 forming a ceiling of the fresh food compartment 14. A sheet metal mullion 25 is attached to the front of the partition 10 between the tray 20 and the palte 24 (See FIGS. 1 and 3). The three aforementioned elements are adapted to snap fit together to form the tightly packed composite structure of the partition 10 as best seen in FIGS. 1, 3 and 4, the same being adapted for insertion into the liner 18 in tight fitting relation therewith. When the composite structure is in place in the liner 18, the outside vertical walls of a raised metal edge 26, which extend along the sides and back of the plate 24, is aligned closely adjacent to the platic walls of the liner 18.

in order to effect a thermally secure and relatively air tight seal between the compartments 12 and 14, an elongated strip 28 of flexible, compressible and resilient insulating material, such as polyurethane, is folded longitudinally over the top of the edge 26 so as to extend around the sides and back of the plate 24. The folded portion of the strip 28 lying outside the plate 24 thus fills the gap between the edge 26 and the adjacent vertical walls of the liner 18 best seen in FIG. 4. Similarly, the folded portion of the strip 28 lying inside the plate 24 forms an insulating seal between the divider 22 and edge 26. Since the metal plate 24 and the plastic liner 18 expand and contract at different rates when subjected to the usual thermal variations encountered in refrigerator operation, the horizontal gap distance between the edge 26 and the adjacent vertical walls of the liner 18 can be expected to vary typically by as much as one-eighth inch, more or less. The compressible, resilient quality of the strip 28 will permit such gap variations up to as much as one-quarter inch, more or less, while continuing to maintain an effective air tight and thermally secure seal thereacross. Accordingly, the strip 28 will not only permit thermally produced gap variations but also gap variations resulting from normal dimensional changes typically encountered in the manufacture of large quantities of plates and liners used with one another as just described. As best shown in FIG. 4, the opposite folded portion of the strip 28 lying within the plate 24 extends around and under a corner portion of the divider 22 to insure an effective thermal seal across the gap between the divider 22 and the edge 26. The portion of the strip 28 lying within the plate 24 around the edge 26 tends to center the tray 20 and divider 22 against the plate 24 to properly align the composite structure for insertion into the liner 18.

The partition 10 is inserted through the access opening and into the liner 18 along a pair of channels 30 formed on the sides of the latter and extending from the access opening to the back thereof. The channels are partially defined by a pair of lower ledges 32 upon which bottom side portions of the plate 24 and partition 10 are supported, and a pair of upper ledges 34 which overhang and overlap a pair of raised flat rims 36 formed on and extending along the sides of the tray 20. The width of the overlap between the ledges 34 and the rims 36 should be sufficient to permit the tray 20 and the liner 18 to expand and contract relative to one another throughout the normal range of thermal variations of the refrigerator without producing unsightly horizontal gaps between them. The overlapping character of these elements also permits reasonable manufacturing variations in the dimensions of the liner 18 and tray 20 without resulting in such an unsightly gap.

The outer metal shell 16 is folded around the front of the liner 18 so as to form a pair of vertically extending metal strips 38 on opposite sides of the access opening. At the entrance to the channels 30, the front vertically extending surfaces 40 of the liner 18 are interrupted to form upper and lower surfaces 40*a, b*.

A pair of triangular shaped frontal portions 42 of the liner 18 extend downward from a recessed position under the base of the upper surfaces 40*a* and diagonally outward therefrom to a vertex. From the vertex, a relatively narrow frontal portion 44 of the liner 18 extends downward behind each strip 38 on each side of the access opening to the top of the lower surfaces 40*b*. The vertical distance between the upper and lower surfaces 40*a, b* on each side of the access opening to the liner 18 constitutes the entrance to the channels 30.

To prevent unsightly vertical gaps from occurring between the front sides of the tray 20 and the edges of the vertical strips 38 caused by thermal variations or reasonable manufacturing dimensional differences, a pair of laterally projecting tabs 46 are formed on the rims 36. As the partition 10 is inserted into the liner 18, the tabs 46 may be snapped by hand over and behind the vertical edges of the strips 40 immediately in front of the triangular, tapered surfaces 42. The vertical edges of the tabs 46 should project only partially into the gap behind the strips 38 and in front of the surfaces 42 so as to permit further expansion therein as the result of anticipated thermally produced dimensional changes. A front entrance portion 48 of the channels 30 is tapered horizontally outward toward the access opening for ease of initial insertion of the partition 10 into the channels 30 without causing binding of the partition 10 near the front ends of the channels 30.

In the manner thus described, we provide a partition between the freezer and fresh food compartments of a refrigerator of the type employing a plastic inner liner. The structural arrangement provides considerable leeway for dimensional variations between component parts caused either by normal manufacturing variations or temperature changes without resulting in unsightly or alarming gaps between them. In addition to these advantageous appearance aspects, the structure also provides high quality thermal separation between the freezer and fresh food compartments.

Although the present invention has been described with respect to specific details of a certain preferred embodiment thereof, it is not intended that such details limit the scope and coverage of the present invention otherwise than as set forth in the following claims.

I claim:

1. Compartment partitioning means for a refrigerator cabinet of the type containing an outer shell and a plastic inner liner comprising a metal plate defining a surface of a fresh food compartment and having a raised edge extending along the sides and back thereof, an elongated strip of compressible, resilient material folded longitudinally across and along said edge to form a thermally insulating seal between said plate and the adjacent walls of said liner, a mass of insulating material forming a thermal compartment divider disposed against said plate, said strip also forming a thermally insulating seal between said plate and divider, a plastic tray defining a surface of a freezer compartment and having raised flat rims extending along the sides thereof, said tray being disposed against said divider, said plate, divider and tray forming a partition, and a pair of channels formed on the sides of said liner and being partially defined by a pair of ledges which overlap said flat rims such that said liner and tray may be spaced relative to one another without producing an unsightly gap therebetween.

2. The partitioning means of claim 1 wherein said plate defines a ceiling for said fresh food compartment, and said tray defines a floor for said freezer compartment.

3. The partitioning means of claim 1 wherein said elongated strip is constructed of polyurethane foam material.

4. The partitioning means of claim 1 wherein said divider is constructed of expanded styrene bead.

5. The partitioning means of claim 1 further comprising a pair of tabs laterally projecting from the front sides of said tray behind frontal edges of said outer shell to permit said tray to become spaced relative to said shell without producing unsightly gaps therebetween.

6. Compartment partitioning means for a refrigerator cabinet of the type containing an outer shell and a plastic inner liner defining sides, a back and an access opening comprising a plastic tray defining a surface for a refrigerator compartment and having raised flat rims extending along each side thereof, and a pair of elongated channels formed on the sides of said liner and extending between said access opening and back, said channels each being partially defined by an upper ledge which overlaps a different one of said rims such that said liner and tray may expand and contract toward and away from one another without producing unsightly horizontal gaps therebetween.

* * * * *